United States Patent [19]

Taniguchi

[11] Patent Number: 4,609,278

[45] Date of Patent: Sep. 2, 1986

[54] HEAT FIXING DEVICE

[75] Inventor: Akihiko Taniguchi, Nara, Japan

[73] Assignee: Sharp Kabushiki Kaisha, Osaka, Japan

[21] Appl. No.: 733,800

[22] Filed: May 14, 1985

[30] Foreign Application Priority Data

May 14, 1984 [JP] Japan ..... 59-98136

[51] Int. Cl.[4] ..... G03G 15/00

[52] U.S. Cl. ..... 355/3 FU; 355/14 FU; 219/216

[58] Field of Search ..... 355/3 FU, 14 FU; 219/216, 244, 388, 469

[56] References Cited

U.S. PATENT DOCUMENTS 3,833,790 9/1974 Quant et al. ..... 219/216
4,104,692 8/1978 Sudo et al. ..... 219/216 X
4,367,037 1/1983 Nishikawa ..... 355/3 FU X
4,480,908 11/1984 Anzai et al. ..... 355/14 FU

*Primary Examiner*—Arthur T. Grimley
*Assistant Examiner*—C. Romano
*Attorney, Agent, or Firm*—Birch, Stewart, Kolasch & Birch

[57] ABSTRACT

A heat fixing device for use in a copying apparatus, including a heating roller, a pressing roller, an ambient temperature sensor for detecting ambient temperature of the copying apparatus, a decision device for making a decision as to whether or not the ambient temperature is not more than a predetermined temperature, and an intermittent drive device for intermittently driving the heating roller and the pressing roller in a waiting mode of the copying apparatus when the ambient temperature is not more than the predetermined temperature.

4 Claims, 6 Drawing Figures

HEAT FIXING DEVICE

BACKGROUND OF THE INVENTION

The present invention generally relates to a copying apparatus or the like and more particularly, to a heat fixing device for use in the copying apparatus or the like, in which a drop of temperature of the heating roller can be prevented.

Conventionally, in a copying apparatus including a fixing device composed of a pressing roller and a heating roller provided with a heater, there is a drawback that since transfer papers are cold and a large amount of heat of the heating roller is absorbed by the pressing roller in the case where the copying apparatus is operated under low ambient temperatures not exceeding 10° C., automatic feed copying of an original document to produce a plurality of, for example, 10 transfer papers or more lowers the temperature of the heating roller dramatically as shown in FIG. 1. FIG. 1 illustrates temperature characteristics of the heating roller, i.e. changes of the temperature of the heating roller with time. The heating roller is maintained at a high fixing temperature of 180° C. by a heater. However, the temperature of the heating roller gradually drops upon automatic feed copying of the original document to produce a plurality of transfer papers and finally, during a time period A, drops below a temperature (indicated by a one-dot chain line) leading to improper fixing of an image on the transfer paper.

In order to obviate such a drawback of the known heat fixing device, there has been proposed a heat fixing device in which a heater of a heating roller has an increased rated heating electric power so as to compensate for drop of temperature of the heating roller in the case of operation of the copying apparatus under low ambient temperatures of the copying apparatus. To this end, the heater of the heating roller has a rated electric power of, for example, 1.2 kW so as to heat the heating roller to the fixing temperature of 180° C. in about 30 sec. when the ambient temperature of the copying apparatus is 20° C. However, when the heater having such a high rated electric power as described above is used in the case where the copying apparatus is operated by a general commercial electric source, such a problem arises that since a light source lamp of the copying apparatus is turned on during a copying operation of the copying apparatus, electric power consumed by the copying apparatus becomes larger than the electric power supplied from the commercial power source so as to exceed a rated capacity of the receptacle, etc. Therefore, in this prior art heat fixing device provided with the heater having a large rated electric power, since actuation of the heater is required to be temporarily stopped so as to prevent the power consumption of the copying apparatus from exceeding the electric power supplied from the commercial power source during the copying operation of the copying apparatus, it is impossible to maintain the heating roller at the fixing temperature at all times.

In order to maintain the heating roller at the fixing temperature, there has been proposed, in addition to that referred to above, another heat fixing device shown in FIG. 2. This known heat fixing device includes a heating roller 1 provided at its central portion with a heater 3, and a pressing roller 2. A thickness t1 of an aluminium layer 4 of the heating roller 1 is set as large as 3 to 5 mm so as to improve the heat insulating property of the heating roller 1. When the thickness of the aluminium layer 4 is increased as described above, the amount of heat dissipated from the heating roller 1 is reduced. However, in the field of copying apparatus or the like, a keen demand for the reduction of the waiting time period of an operator lead to a recent trend for a decrease of the warm-up time period of the copying apparatus or the like. However, since this known arrangement of FIG. 2 is designed to secure the fixing temperature by increasing the thickness of the aluminum layer 4, a long time period is required for raising the temperature of the heating roller 1 to the fixing temperature of 180° C., thereby resulting in an increase of the warm-up time period of the copying apparatus.

Referring to FIG. 3, there is shown a further prior art heat fixing device. The prior art heat fixing device includes an upper roller 1' provided with a heater 3' and a lower roller 2' provided with a heater 5. In this prior art heat fixing device, although a thickness t2 of an aluminium layer 4' of the upper roller 1' is not required to be increased to such an extent as in the known arrangement of FIG. 2, both the upper and lower rollers 1' and 2' are, respectively, provided with heaters 3' and 5, thus resulting in a rise of its production cost. This prior art heating fixing device further has such a disadvantage as large power consumption of the heaters 3' and 5.

SUMMARY OF THE INVENTION

Accordingly, an essential object of the present invention is to provide, in view of the disadvantages inherent in the conventional heating fixing devices referred to above, an improved heat fixing device including a heating roller and a pressing roller, in which the heating roller and the pressing roller are driven in the waiting mode of a copying apparatus so as to maintain the temperature of the pressing roller by the heat of the heating roller such that the heating roller is maintained at a fixing temperature at all times through prevention of a drop in the temperature of the heating roller at the time of operation of the copying apparatus to adjust the temperature of the pressing roller under low ambient temperatures of the copying apparatus, while eliminating the need for the additional provision of a heater or an increase in the thickness of an aluminum layer of the heating roller.

In order to accomplish this object of the present invention, a heat fixing device for use in a copying apparatus, including a heating roller which is subjected to heating control to high temperatures and a pressing roller held substantially in pressing contact with the heating roller and rotated together with the heating roller at the time of the fixing operation of the heat fixing device, is provided which comprises: an ambient temperature sensor for detecting the ambient temperature of the copying apparatus, a decision means for determining as to whether or not the ambient temperature is at or above a predetermined temperature in response to detection of the ambient temperature by the ambient temperature sensor and an intermittent drive means which is so controlled by the decision means as to intermittently drive the heating roller and the pressing roller during a waiting mode of the copying apparatus when the ambient temperature is not more than the predetermined temperature.

BRIEF DESCRIPTION OF THE DRAWINGS

This object and other features of the present invention will become apparent from the following description taken in conjunction with the preferred embodiment thereof with reference to the accompanying drawings, in which.

Before the description of the present invention proceeds, it is to be noted that like parts are designated by like reference numerals throughout the several views of the accompanying drawings.

DETAILED DESCRIPTION OF THE INVENTION

Figure 5:
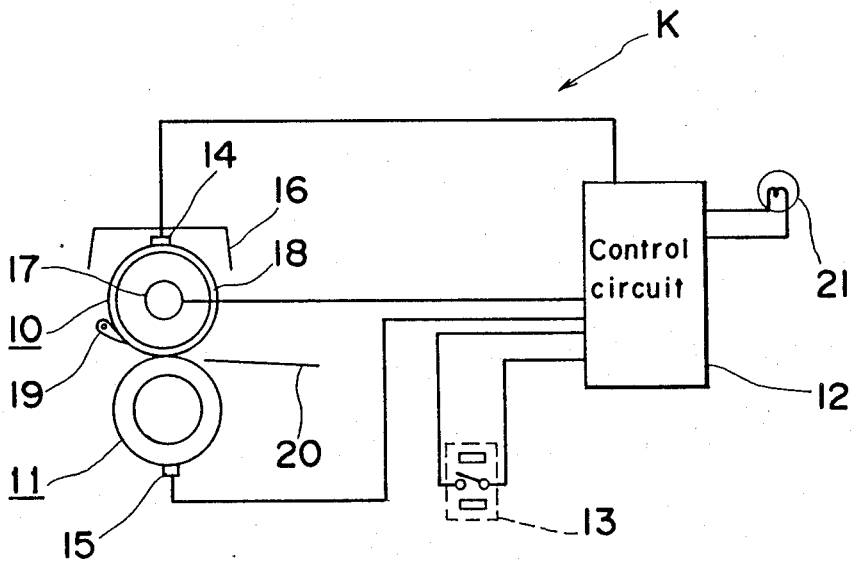
FIG. 5 is a schematic view of the heat fixing device of FIG. 4.

Referring now to the drawings, there is shown in FIG. 5, a heat fixing device K for a copying apparatus, according to one preferred embodiment of the present invention. The heat fixing device K generally includes a heating roller (hereinbelow, referred to as "an upper roller") 10 and a pressing roller (hereinbelow, referred to as "a lower roller") 11 provided below the upper roller 10. The upper roller 10 is provided, at a central portion thereof, with a heater 17 for heating the upper roller 10, while the lower roller 11 is substantially brought into pressing contact with the upper roller 10. An outer peripheral portion of the upper roller 10 is formed by a thin aluminium layer 18 of an annular shape having a thickness of 2 mm and Teflon (name used in trade and manufactured by Du Pont of the U.S.) is coated on the outer peripheral surface of the aluminum layer 18. The heater 17 has a rated heating electric power of 1.2 kW.

The heat fixing device K further includes temperature sensors 14 and 15 for detecting the temperature of the upper and lower rollers 10 and 11, respectively, a cover 16 provided above the upper roller 10, a scraper 19 for separating from the upper roller 10 a transfer paper brought into close contact with the upper roller 10 during fixing operation of the heat fixing device K, and a transport guide 20 for guiding the transfer paper between the upper and lower guide rollers 10 and 11. The cover 16 is provided for covering the upper roller 10 so as to prevent free dissipation of heat from the upper roller 10.

Furthermore, the heat fixing device K includes a control circuit 12, a temperature-sensitive reed switch 13 for detecting the ambient temperature of the copying apparatus, and a lamp 21 provided at an operating panel (not shown). The control circuit 12 is arranged to vary the amount of electric current supplied to the heater 17 in accordance with temperature changes of the upper roller 10 so as to control heating of the upper roller 10 such that the upper roller 10 is maintained at a fixing temperature of 180° C. Meanwhile, when the ambient temperature of the copying apparatus is 10° C. or less, the contact of the reed switch 13 is closed so as to turn on the reed switch 13. The control circuit 12 is also arranged to control a rotary drive unit (not shown) of a known construction for rotating the upper and lower rollers 10 and 11 so as to intermittently drive and stop the rotary drive unit when the reed switch 13 is held in the "on" state. The lamp 21 is turned on in a copying enabling mode of the copying apparatus and is turned off in a waiting mode of the copying apparatus.

It is to be noted that the reed switch 13, temperature sensors 14 and the 15, heater 17, lamp 21 and rotary driver unit are connected to the control circuit 12.

Hereinbelow, one example of a concrete processing sequence for controlling temperatures of the upper and lower rollers 10 and 11 in the waiting mode of the copying apparatus will be described with reference to the flow chart of FIG. 4. Initially, a decision is made at step S1as to whether or not the reed switch 13 is turned on so as to decide whether or not the ambient temperature of the copying apparatus is 10° C. or less. In the case of "YES" at step S1, namely when the ambient temperature of the copying apparatus is not more than 10° C., step S2 follows. In this example, it is so arranged that the lower roller 11 is maintained at a temperature of about 70° C. Thus, a decision is made at step S2 by using the temperature sensor 15 as to whether or not the temperature of the lower roller 11 is at or greater than 70° C. In the case of "NO" at step S2, namely when the temperature of the lower roller 11 is less than 70° C., drive of the upper and lower rollers 10 and 11 is started at step S3. The upper and lower rollers 10 and 11 are rotated in substantially pressing contact with each other. A portion of heat of the upper roller 10 is absorbed by the lower roller 11 so as to raise the temperature of the lower roller 11. The drive of the upper and lower rollers 10 and 11 is continued through detection of the temperature of the lower roller 11 by the use of the temperature sensor 15 until the temperature of the lower roller 11 reaches 70° C. When it is detected at step S4 by the temperature sensor 15 that the temperature of the lower roller 11 has risen to 70° C. through heat transfer from the upper roller 10 to the lower roller 11, the drive of the upper and lower rollers 10 and 11 is stopped at step S5. The above described procedure for raising the temperature of the lower roller 11 through rotation of the upper and lower rollers 10 and 11 is performed in the waiting mode of the copying apparatus.

At the time when the drive of the upper and lower rollers 10 and 11 is stopped at step S5, a timer (not shown) monitored by the control circuit 12 starts counting a preset time period of about 20 to 30 min. When it is found at step S6 by monitoring the timer that the preset time period of the timer has elapsed, the program flow returns to step S1 so as to repeat the above described procedure such that the temperature of the lower roller 11 is raised in the case where the temperature of the lower roller 11 is lower than 70° C. When a copying operation is performed while the timer is being monitored, the temperature of the lower roller 11 is slightly raised through heat transfer from the upper roller 10 to the lower roller 11 at the time of the fixing operation of the heating fixing device. Accordingly, in this case, the timer is reset by depressing a "copy start" button so as to restart counting of the preset time period after completion of the copying operation.

Figure 1:
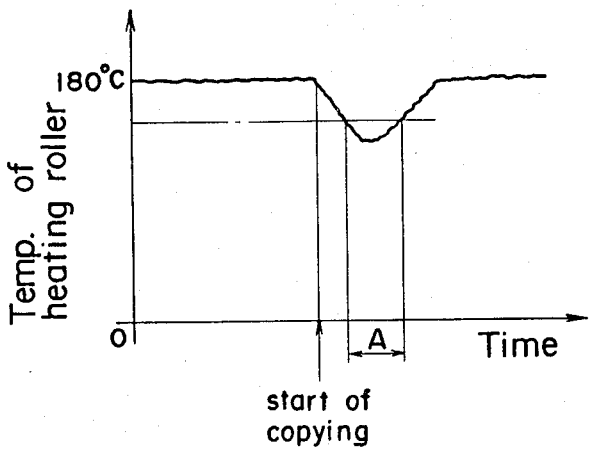
Fig. 1 PRIOR ART
FIG. 1 is a graph indicative of temperature characteristics of a heating roller employed in a first prior art heat fixing device (already referred to)
Figure 2:
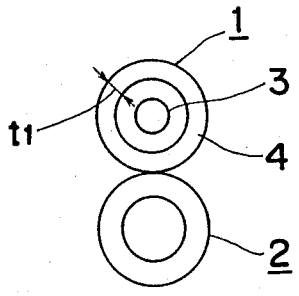
Fig. 2 PRIOR ART
FIGS. 2 and 3 are schematic views showing configurations of rollers employed in second and third prior art heat fixing devices, respectively (already referred to)
Figure 3:
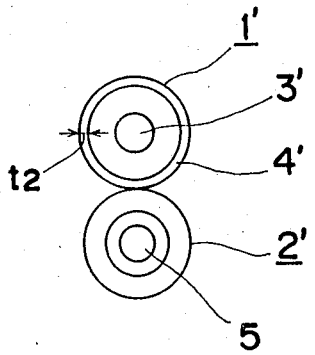
Fig. 3 PRIOR ART
Figure 4:
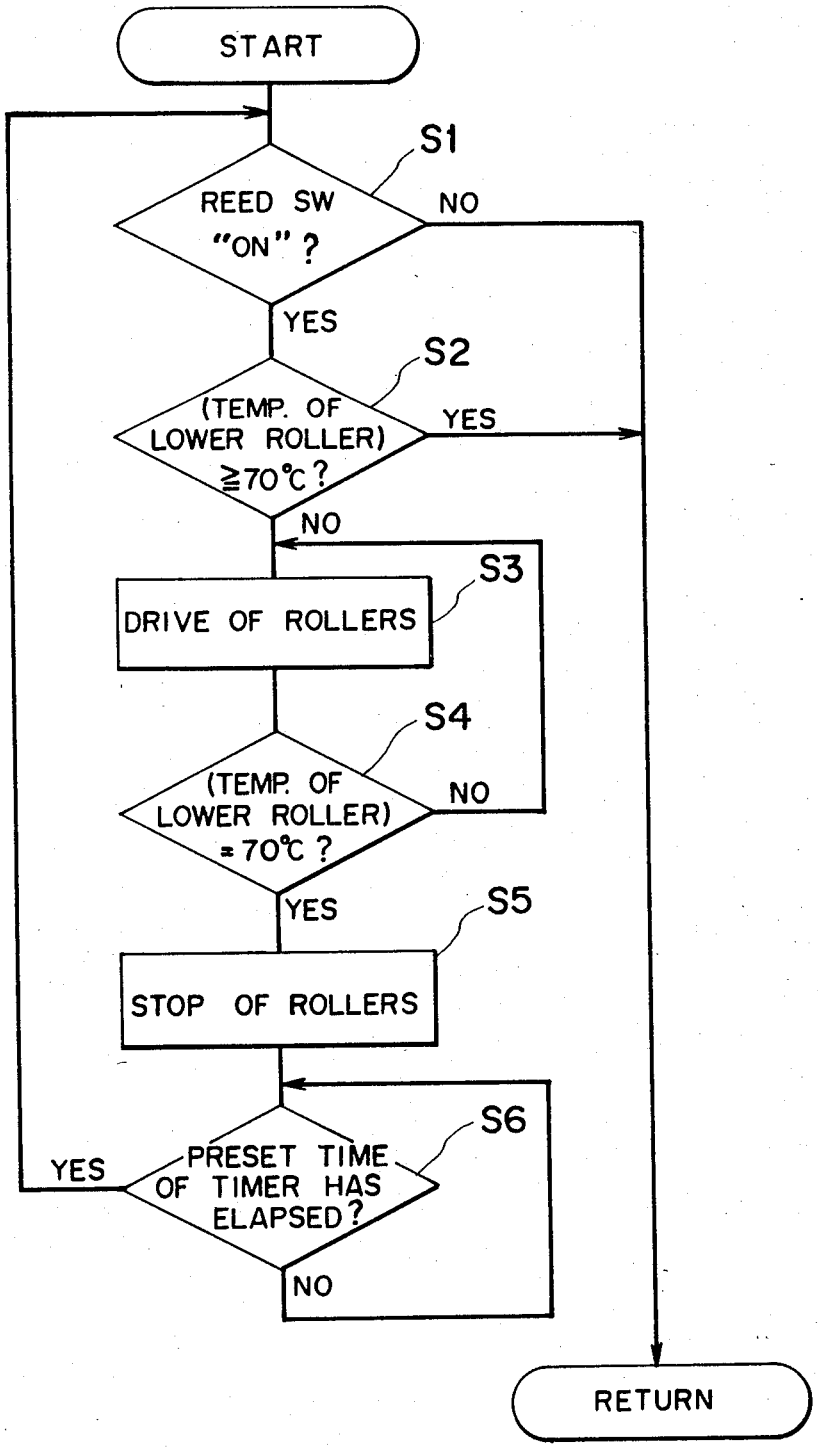
FIG. 4 is a flow chart of a processing sequence of temperature control of rollers employed in a heat fixing device according to the present invention.
Figure 6:
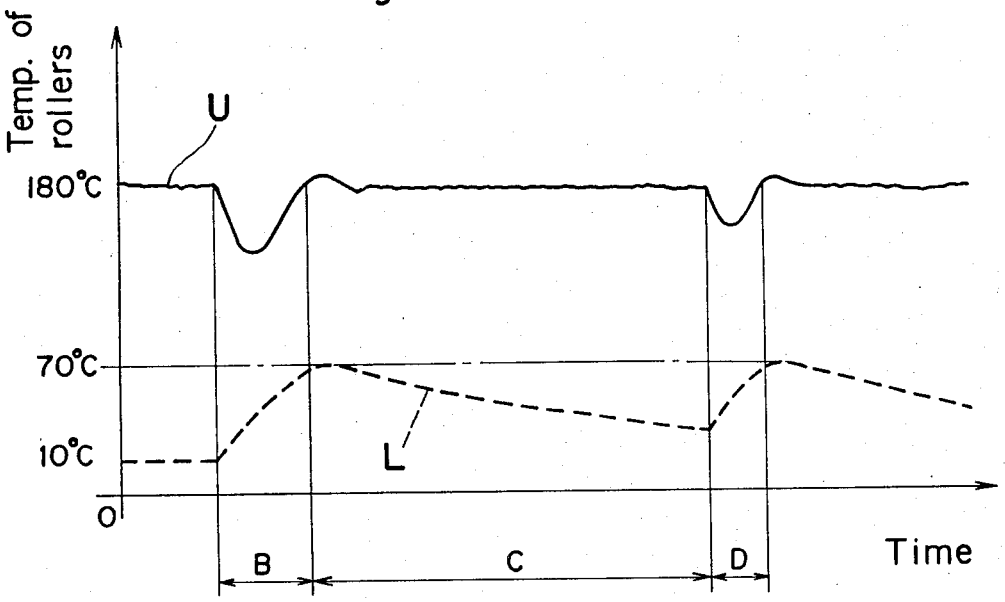
FIG. 6 is a graph indicative of temperature characteristics of the rollers of the heat fixing device of FIG. 4.

FIG. 6 shows temperature changes of the upper and lower rollers 10 and 11 with time in the course of the processing sequence of FIG. 4. In FIG. 6, the solid line U and the broken line L illustrate the temperature changes of the upper and lower rollers 10 and 11, respectively. In FIG. 6, the characters B and D represent time periods of step S3 during which the upper and lower rollers 10 and 11 are driven, while the character C represents a time period of step S5 during which the drive of the upper and lower rollers 10 and 11 is stopped through monitoring of the timer. As can be seen from the broken line L, the temperature of the lower roller 11 is raised to 70° C. in about about 10 to 20 sec. through heat absorption from the upper roller 10 to the lower roller 11 and then, gradually drops during the subsequent time period C. This rate of drop of the temperature of the lower roller 11 during the time period C depends on a difference between the temperature of the lower roller 11 and the ambient temperature of the copying apparatus, etc. In this example of FIG. 4, the temperature of the lower roller 11 does not drop down to its heating start temperature prior to the time period B, i.e., 10° C. In the time period D following the time period C, the upper and lower rollers 10 and 11 are driven again and the temperature of the lower roller 11 is raised to 70° C. more rapidly than in the time period B, i.e., in less than 10 sec.

On the other hand, during the time periods B and D, the temperature of the upper roller 10 drops through heat absorption from the upper roller 10 to the lower roller 11. However, since an upper limit of the temperature of the lower roller 11 is set at 70° C., the temperature of the upper roller 10 does not drop down to low temperatures leading to an improper fixing operation.

As described above, the temperature of the lower roller 11 is raised periodically through intermittent drive of the upper and lower rollers 10 and 11 by stopping drive of the upper and lower rollers 10 and 11 during the time period C such that the temperature of the lower roller 11 is maintained with slight differences, in temperature, between the upper and lower rollers 10 and 11. Thus, even if automatic feed copying of an original document to produce a plurality of, for example, 10 transfer papers is performed under low ambient temperatures of the copying apparatus, only a slight amount of heat of the upper roller 10 is absorbed by the transfer papers with a minimum heat transfer from the upper roller 10 to the lower roller 11, so that it becomes possible to prevent the temperature of the upper roller 10 from dropping far below the fixing temperature of 180° C. Furthermore, since the temperature of the lower roller 11 is maintained with a slight difference, in temperature, between the upper and lower rollers 10 and 11, a temperature change of the upper roller 10 during the copying operation under low ambient temperatures of the copying apparatus can be minimized, so that only a small amount of electric current is required to be supplied to the heater 17 in the time period C during which drive of the upper and lower rollers 10 and 11 is stopped.

The intermittent drive of the upper and lower rollers 10 and 11 is performed in the waiting mode of the copying apparatus as described earlier. Thus, during drive of the upper and lower rollers 10 and 11, for example, during the time periods B and D, the lamp 21 is turned off so as to prohibit the copying operation. Accordingly, even if a larger amount of electric power is supplied to the heater 17 in order to compensate for drop of the temperature of the upper roller 10 upon drive of the upper and lower rollers 10 and 11 during the time periods B and D, power consumption of the copying apparatus does not become excessive because a light source lamp of the copying apparatus is turned off due to prohibition of the copying operation by the lamp 21. Furthermore, even if automatic feed copying of the original document to produce a plurality of the transfer papers is performed during the time period C, drop of the temperature of the upper roller 10 is prevented so as to maintain the upper roller 10 at the fixing temperature by supplying a small amount of electric power to the heater 17. Consequently, the temperature of the upper roller 10 can be safely controlled by using the heater 17 having the large rated heating electric power of 1.2 kW without consuming an electric power exceeding a permissible electric power of the copying apparatus. Thus, in the heat fixing device K, since it becomes possible to secure the fixing temperature at all times by using the heater 17 having the large rated heating electric power without the need for increasing the thickness of the aluminium layer 18 of the upper roller 10 or providing a heater also at the lower roller 11, a time period required for warming up the heat fixing device can be reduced and a production cost of the heating fixing device can be lowered. Furthermore, since heating of the upper roller 10 is performed in the waiting mode of the copying apparatus so as to prevent drop of the temperature of the upper roller 10 due to intermittent rotation of the upper and lower rollers 10 and 11, such a danger can be obviated even in the case of operation of the copying apparatus by using electric power supplied from a commercial electric source such that a large electric power exceeding a rated capacity of the receptacle, etc. is consumed for operating the copying apparatus.

As is clear from the foregoing description, in accordance with the present invention, since the heating and pressing rollers are intermittently driven under low ambient temperatures of the copying apparatus so as to transfer a portion of heat of the heating roller to the pressing roller such that the temperature of the pressing roller is maintained, a difference, in temperature, between the heating and pressing rollers is reduced and an excessive drop of the temperature of the heating roller during automatic feed copying of the original document to produce a plurality of the transfer papers can be prevented.

Furthermore, in accordance with the present invention, since heat transfer from the heating roller to the pressing roller is performed through intermittent drive of the heating and pressing rollers in the waiting mode of the copying apparatus without the need for increasing the thickness of the outer peripheral layer of the heating roller or providing the heaters at both the heating and pressing rollers, the heater having a large rated electric power can be operated continuously without being temporarily stopped.

Moreover, in accordance with the present invention, the temperature of the heating roller can be safely controlled to the fixing temperature stably and the time period for warming up the heating fixing device is reduced without the need for increasing power consumption of the copying apparatus, thereby resulting in reduction of the production cost of the heating fixing device.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as being included therein.

What is claimed is:

1. A heat fixing device for use in a copying apparatus, including a heating roller subjected to heating control at high temperatures and a pressing roller held substantially in pressing contact with said heating roller and rotated together with said heating roller at the time of a fixing operation by said heat fixing device, said heat fixing device comprising:

an ambient temperature sensor for detecting ambient temperature of said copying apparatus;

first and second temperature sensors for detecting temperatures of said heating roller and said pressing roller, respectively;

a decision means for determining whether or not the ambient temperature of said copying apparatus is above a predetermined temperature in response to detection of the ambient temperature by said ambient temperature sensor and for determining respective temperatures of said heating roller and pressing roller in response to detection of said respective temperatures by said first and second temperature sensors, said heating roller having been provided with a heater while said pressing roller is not provided with a heater; and an intermittent drive means which is so controlled by said decision means as to intermittently drive said heating roller and said pressing roller during a waiting mode of said copying apparatus when the ambient temperature is not more than said predetermined temperature and the temperature of said pressing roller is not at a predetermined temperature, so as to warm-up said pressing roller;

said decision means also controlling heating of said heating roller so as to maintain said heating roller at a predetermined fixing temperature.

2. The heat fixing device of claim 1, wherein said predetermined fixing temperature is 180° C.

3. The heat fixing device of claim 1, wherein said ambient predetermined temperature is 10° C.

4. The heat fixing device of claim 1, wherein said predetermined temperature of said pressure roller is 70° C.

* * * * *